US010549168B2

(12) United States Patent
Wallace

(10) Patent No.: US 10,549,168 B2
(45) Date of Patent: Feb. 4, 2020

(54) SPORTS TRAINING AID

(71) Applicant: Charles Martin Wallace, Louisville, KY (US)

(72) Inventor: Charles Martin Wallace, Louisville, KY (US)

( * ) Notice: Subject to any disclaimer, the term of this patent is extended or adjusted under 35 U.S.C. 154(b) by 0 days.

(21) Appl. No.: 15/146,701

(22) Filed: May 4, 2016

(65) Prior Publication Data

US 2016/0325166 A1 Nov. 10, 2016

Related U.S. Application Data

(60) Provisional application No. 62/179,263, filed on May 4, 2015.

(51) Int. Cl.

| | |
|---|---|
| ***A63B 69/00*** | (2006.01) |
| ***A63B 39/00*** | (2006.01) |
| ***A63B 41/00*** | (2006.01) |
| *A63B 37/14* | (2006.01) |
| *A63B 43/00* | (2006.01) |
| *A63B 43/06* | (2006.01) |

(52) U.S. Cl.

CPC ..... *A63B 69/0071* (2013.01); *A63B 37/14* (2013.01); *A63B 43/002* (2013.01); *A63B 43/005* (2013.01); *A63B 43/06* (2013.01)

(58) Field of Classification Search

CPC ... A63B 69/0071; A63B 37/17; A63B 43/002; A63B 43/06; A63B 43/005

USPC ..... 473/447, 595, 570, 573, 607, 610, 569; D21/707, 713

See application file for complete search history.

(56) References Cited

U.S. PATENT DOCUMENTS

| | | | | | |
|---|---|---|---|---|---|
| 1,299,092 | A * | 4/1919 | Abrahamson | A63B 43/002 | 473/595 |
| 2,362,064 | A * | 11/1944 | Giesinger | A63B 43/002 | 473/595 |
| 2,789,823 | A * | 4/1957 | Bennett | A63B 67/002 | 473/558 |
| 3,118,675 | A * | 1/1964 | Lyle | A63B 67/00 | 473/569 |
| 3,123,358 | A * | 3/1964 | Czarev | A63B 37/0001 | 473/55 |
| 3,215,434 | A * | 11/1965 | Krysiak | A63D 3/00 | 473/595 |

(Continued)

*Primary Examiner* — Mitra Aryanpour

(74) *Attorney, Agent, or Firm* — Dunan Galloway Egan Greenwald, PLLC; Kevin T. Duncan

(57) ABSTRACT

A polyhedral substantially cube-shaped training aid approximately the size and weight of a basketball and having a side transition, whereby when the training aid is launched in the manner of a basketball shot the rotation of the training aid provides visual feedback representative of a nature of the rotation of the device in flight. The training aid may include a level indicator device, sound indicator, vibration indicator, and side transitions are generally beveled. The training aid may include visual outer-markings on one or more external surfaces of the aid to visually indicate the nature of the rotation of the device when launched. Alternatively, the training aid is removably placed over the outside surface of a basketball so as to at least partially square off a first perspective of the basketball, the training aid being configured and constructed of material that permits the training aid to become removably affixed to the outer surface of the basketball.

8 Claims, 7 Drawing Sheets

(56) References Cited

U.S. PATENT DOCUMENTS 3,811,677 A * 5/1974 Saladrigas ..... A63B 25/00 473/595
3,858,876 A * 1/1975 Williams ..... A63B 43/008 473/450
D235,358 S * 6/1975 Dufaud ..... D21/707
3,970,307 A * 7/1976 Breglia ..... A63B 59/30 473/514
4,570,931 A 2/1986 Martin
4,826,177 A * 5/1989 Ponte ..... A63B 43/002 473/569
4,971,334 A * 11/1990 Stewart ..... A63B 43/005 473/573
4,979,751 A * 12/1990 Sullivan, III ..... A63B 43/06 473/570
D317,805 S * 6/1991 Swan ..... D21/707
5,131,665 A * 7/1992 Myers ..... A63B 43/002 473/569
5,186,458 A * 2/1993 Redondo ..... A63B 43/06 473/570
5,251,908 A * 10/1993 Myers ..... A63B 43/002 473/607
D347,669 S * 6/1994 Renfro ..... D21/707
D352,322 S * 11/1994 Mullaney ..... D21/707
D358,858 S * 5/1995 McGreevy ..... D21/707
5,511,782 A * 4/1996 Maley ..... A63B 43/002 473/569
5,827,109 A * 10/1998 Krull ..... A63H 33/18 446/373
6,432,008 B1 * 8/2002 Lemmon ..... A63B 43/002 473/569
D498,801 S * 11/2004 Cochrane ..... D21/707
D516,640 S * 3/2006 Shore ..... D21/707
D516,647 S * 3/2006 Yang ..... D21/713
D665,041 S * 8/2012 Tolis ..... D21/781
8,579,741 B2 * 11/2013 Heland ..... A63B 43/002 473/595
D695,350 S * 12/2013 Doleshal ..... D20/99
D712,495 S * 9/2014 Nagi ..... D21/707
2003/0181266 A1 9/2003 Sowders
2004/0076938 A1 * 4/2004 Publicover ..... A63B 41/08 434/248
2005/0009650 A1 * 1/2005 Sullivan, III ..... A63B 43/06 473/570
2005/0119071 A1 6/2005 Carbonero
2006/0293112 A1 12/2006 Yi
2014/0277629 A1 9/2014 Zwaschka et al.
2014/0309059 A1 10/2014 Minch

* cited by examiner

SPORTS TRAINING AID

CROSS REFERENCE TO RELATED APPLICATION

The present application claims benefit of priority to and is a continuation of U.S. Provisional Pat. Application Ser. No. 62/179,263, filed May 4, 2015, and entitled QUBE (Wallace), which is hereby incorporated by reference herein in its entirety.

FIELD OF INVENTION

The present invention generally relates sports training aids and more particularly relates to basketball training aids and more particularly to shooting aids.

BACKGROUND OF THE INVENTION

Basketballs are spherical in shape and when launched toward a basket, as when used in sporting contests in the context of a shot, do not simply rotate on a given axis. Release and rotation of a basketball are critical characteristics of a successful shot. Proper positioning of the "shooting hand" and the "guide hand" are essential to a proper and successful technique. One widely recognized problem associated with shooting a basketball is that proper hand position and rotation are elusive skills. Often, to the player's detriment, a shot has undesired wobble and can be launched like a knuckleball. This wobble is associated with a lower shooting percentage. Exacerbating the problem for instructors and coaches is that rotation of a basketball in flight is a visual experience and is difficult to communicate to the player. Much of it is "feel" and there is little direct feedback associated with a shot.

What is needed is a basketball training aid that enhances a player's learning experience and leads to proper form and technique. What is needed is a basketball training aid that gives the player immediate feedback while shooting the ball. In addition, feedback is needed for the coach too as detecting the precise problem with a player's shooting technique is difficult for the coach/teacher as a sphere reveals few clues to the problem.

When shooting a basketball there are certain recognized "non-negotiables" including: proper hand placement; proper ball rotation; proper wrist elbow relationship; and proper hand location in relation to the body. Because players and students are of a wide variety of ages, gender and skill level, what is needed is a way to meet the diversity of talent player types to meet a wide range of applications.

A long felt yet unmet need is a training aid generally the size and weight of a basketball, and actually a variety of basketball configurations as intended for a variety of player ages, sizes and skill levels, and designed to provide players with immediate feedback including visual feedback as to the nature of the rotation on the training aid when launched in an intended manner.

SUMMARY OF THE INVENTION

The present invention is designed to address the unmet needs associated with imperfect shooting of a basketball and provides students/players with immediate feedback, visually and, optionally, otherwise, as to the nature of the shooter's release and an indication of what issues need to be addressed. Release and rotation of a basketball are critical characteristics of a successful shot. The present invention is a polyhedral device and in an exemplary embodiment is a six-sided hexahedron (referred to herein as the "Qube") and may be configured and used to train players of all ages and skill levels, both male and female, on the basic fundamentals of how to shoot a basketball. The present invention may also have 18 sides wherein the edges of the hexahedron are chamfered or beveled creating an additional side at each edge of the hexahedron. Proper positioning of the "shooting hand" and the "guide hand" are essential to a proper and successful technique. The invention may be employed, for example, in three sizes and may be used in all sports and fitness exercises. The Qube is a visual aid for reinforcing the mechanics of a good shot.

A first embodiment of the invention provides a substantially cube-shaped training aid approximately the size of a conventional basketball and having at least one side transition, whereby when the training aid is launched in the manner of a basketball shot the rotation of the training aid provides visual feedback representative of a nature of the rotation of the device in flight. The invention may be further characterized as follows: further comprising a level indicator device, the level indicator device being one of a visual level having a bubble float with translucent body, a sound indicator, a vibration indicator; and wherein the side transition are generally beveled edges, and wherein three of the plurality of hexagonal side transitions meet at each corner of the set of corners forming corners that end at an end point, each corner defined by two edges of each of the three of the plurality of hexagonal side transitions; wherein the training aid further comprises visual outer-markings on one or more external surfaces of the aid to give further visual indication of the nature of the rotation of the device when launched, wherein the outer-markings comprise different color portions, or strips or arrows or series of stripes or illuminated or reflective indicators, wherein one or more outer surface comprises a pebbled surface to replicate the leather of a basketball, or a surface conducive to gripping, or wherein the training aid is made in part of a material having a gripping texture, a spongy material, wherein the weight of the training aid approximates that of a traditional basketball.

In a second embodiment, the invention provides a training aid adapted to be disposed over a portion of the outside surface of a basketball so as to at least partially square off a first perspective of the basketball, the training aid being configured and constructed of material that permits the training aid to become removably affixed to the outer surface of the basketball.

The second embodiment of the invention may be further characterized in one or more of the following manners; the training aid comprises an elastic portion that permits expansion to effectively dispose about the basketball in a secured manner; wherein the training aid comprises a two-piece housing and further comprises a fixation mechanism to secure the two-piece housing about the basketball when place on the basketball; comprising a housing adapted to receive through an internal cavity a basketball, whereby with the basketball received in the cavity the training aid provides at least one squared off perspective; and further with the basketball disposed within the internal cavity the basketball securely engages an inner surface of the training aid so as to be fixably disposed thereon and to prevent undesired disconnection with the training aid; wherein the training aid includes one or more of the following to secure the aid in position about the basketball, a VELCRO hook-and-loop fastener strap, a clip and strap combination, an elastic material adapted to be removably disposed about the basketball; wherein with the aid securely disposed on the basketball the aid presents essentially a sphere protruding from the six faces of a cube defined set of planes; wherein the training aid comprises an open faced, cube-shaped combination removably attached to the outer surface of the basketball; comprising a substantially cube-shaped training aid approximately the size of a conventional basketball and having at least one side transition, whereby when the training aid is launched in the manner of a basketball shot the rotation of the training aid provides visual feedback representative of a nature of the rotation of the device in flight; wherein in at least one perspective of the basketball when placed in a user's hand for shooting the user's hand at least partially engages with the training aid.

In addition to the cube-shaped training aid itself, one version of the Qube may be combined with VELCRO hook-and-loop fastener gloves or some other means of attaching the hands to the Qube.

BRIEF DESCRIPTION OF THE DRAWINGS

In order to facilitate a full understanding of the present invention, reference is now made to the accompanying drawings, in which like elements are referenced with like numerals. These drawings should not be construed as limiting the present invention, but are intended to be exemplary and for reference.

DETAILED DESCRIPTION

The present invention will now be described in more detail with reference to exemplary embodiments as shown in the accompanying drawings. While the present invention is described herein with reference to the exemplary embodiments, it should be understood that the present invention is not limited to such exemplary embodiments. Those possessing ordinary skill in the art and having access to the teachings herein will recognize additional implementations, modifications, and embodiments, as well as other applications for use of the invention, which are fully contemplated herein as within the scope of the present invention as disclosed and claimed herein, and with respect to which the present invention could be of significant utility.

Figure 1:
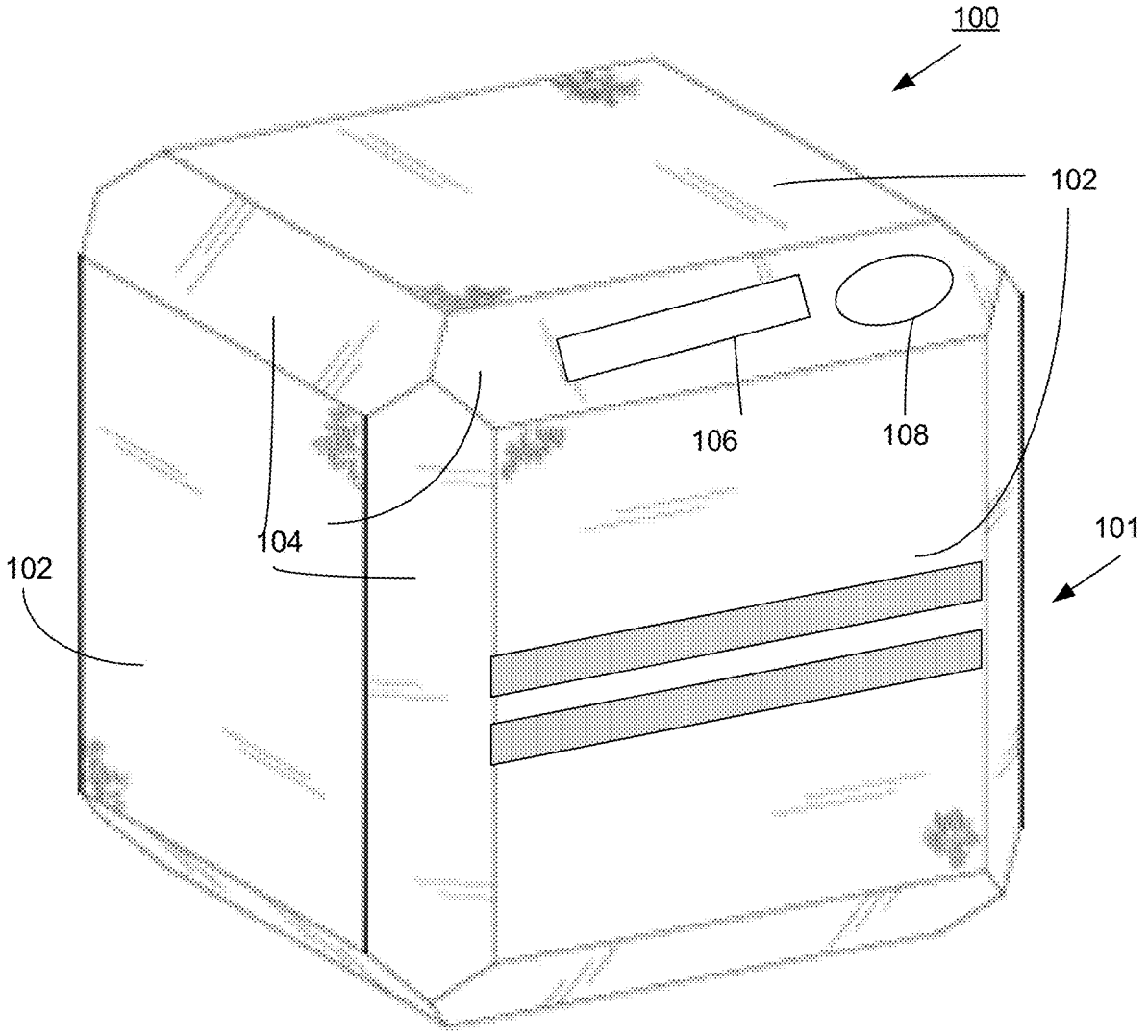
FIG. 1, a perspective view of a first embodiment of a training aid 100 according to the present invention is provided.

With reference to FIG. 1, a perspective view of a first embodiment of the training aid 100, such as for basketball shooting training, in accordance with the present invention. As shown, a substantially cube-shaped (six faces or sides 102) training aid 100 is provided approximately the size of a conventional basketball and having at least one side transition 104. The training aid 100 may be manufactured as a single formed or molded piece or may comprise a plurality of smaller sections glued or otherwise secured together to form the training aid 100. When the training aid is used in training, a user launches in the manner of a basketball shot. The rotation of the training aid provides visual feedback representative of a nature of the rotation of the device in flight. The training aid 100 may include a level indicator device 106. The level indicator device 106 may be one of a visual level having a bubble float with translucent body. In addition, the training aid 100 may include a sound indicator 108 and/or a vibration indicator (not shown) which may be internal to the device. These other indicators may provide haptic or other feedback to the user to help improve shooting performance. The level indicator device 106 may comprise an LCD, LED, or other suitable display and may be located on any side 102 or side transition 104 of the training aid 100; and wherein three of the plurality of hexagonal side transitions meet at each corner of the set of corners forming corners that end at an end point, each corner defined by two edges of each of the three of the plurality of hexagonal side transitions.

Training aid 100 includes one or more side transitions 104, which are shown as generally beveled edges. In addition, the training aid 100 may include visual outer-markings 101 on one or more external surfaces of the aid to give further visual indication of the nature of the rotation of the device when launched. Such outer-markings 101 may include different color portions, or stripes or arrows or series of stripes or illuminated or reflective indicators. In addition, one or more portions of the aid outer surface may comprise a pebbled surface to replicate the leather of a basketball, or a surface conducive to gripping. The training aid is preferably made in part of a material having a gripping texture, a spongy material, wherein the weight of the training aid approximates that of a traditional basketball. Training aid 100 preferably is the same size as a basketball and weighs about the same as a conventional basketball, i.e., 21 ounces+/−one or two ounces. Of course, there are a variety of basketball configurations, e.g., women's basketball, children's basketball, etc., and a training aid 100 may be configured to match with any such conventional configurations (size and weight).

Figure 2:
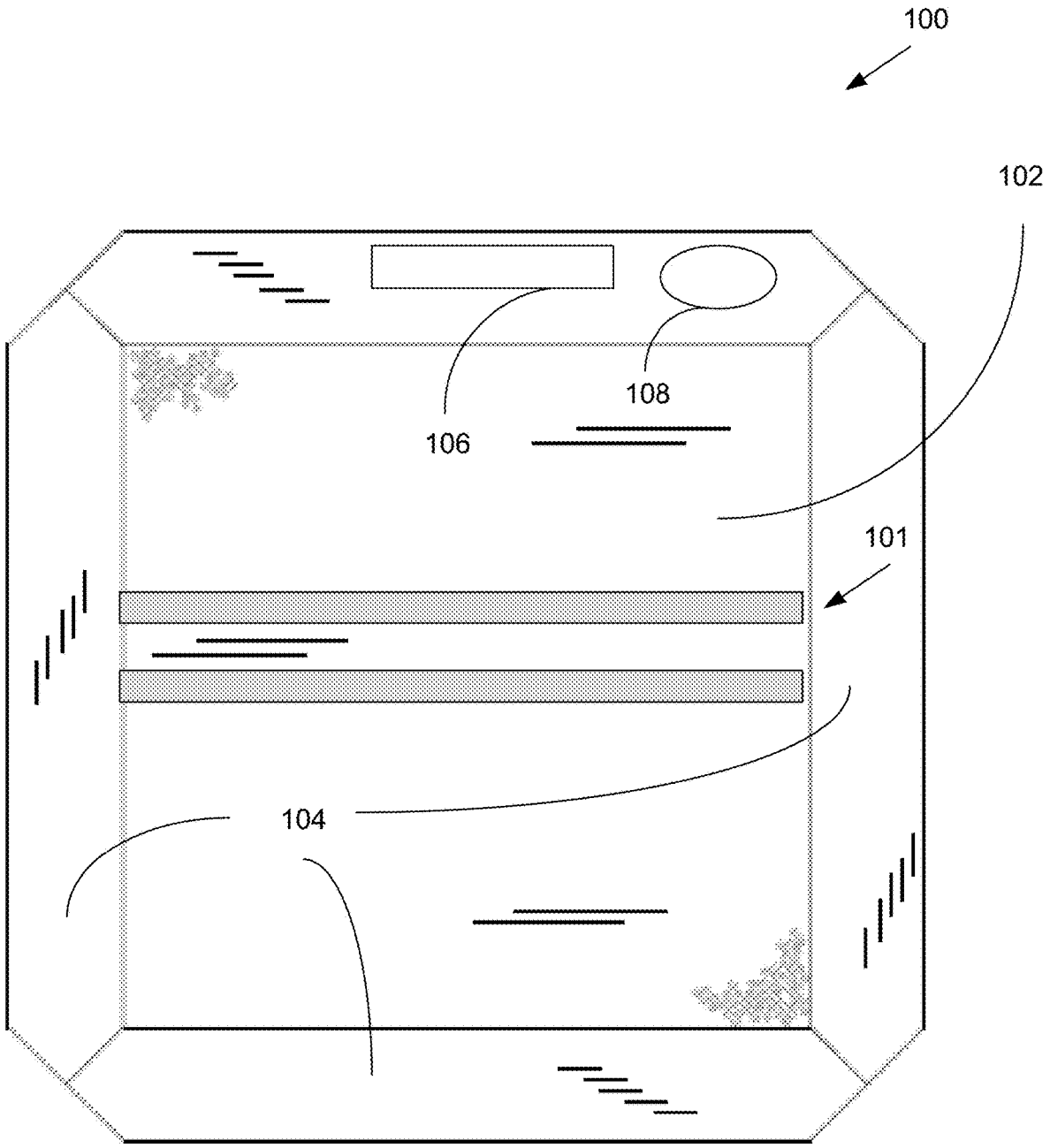
FIG. 2 provides a front perspective view of the training aid of the first embodiment.

FIG. 2 provides a front perspective view of the training aid 100 of the first embodiment as shown in FIG. 1.

Figure 3:
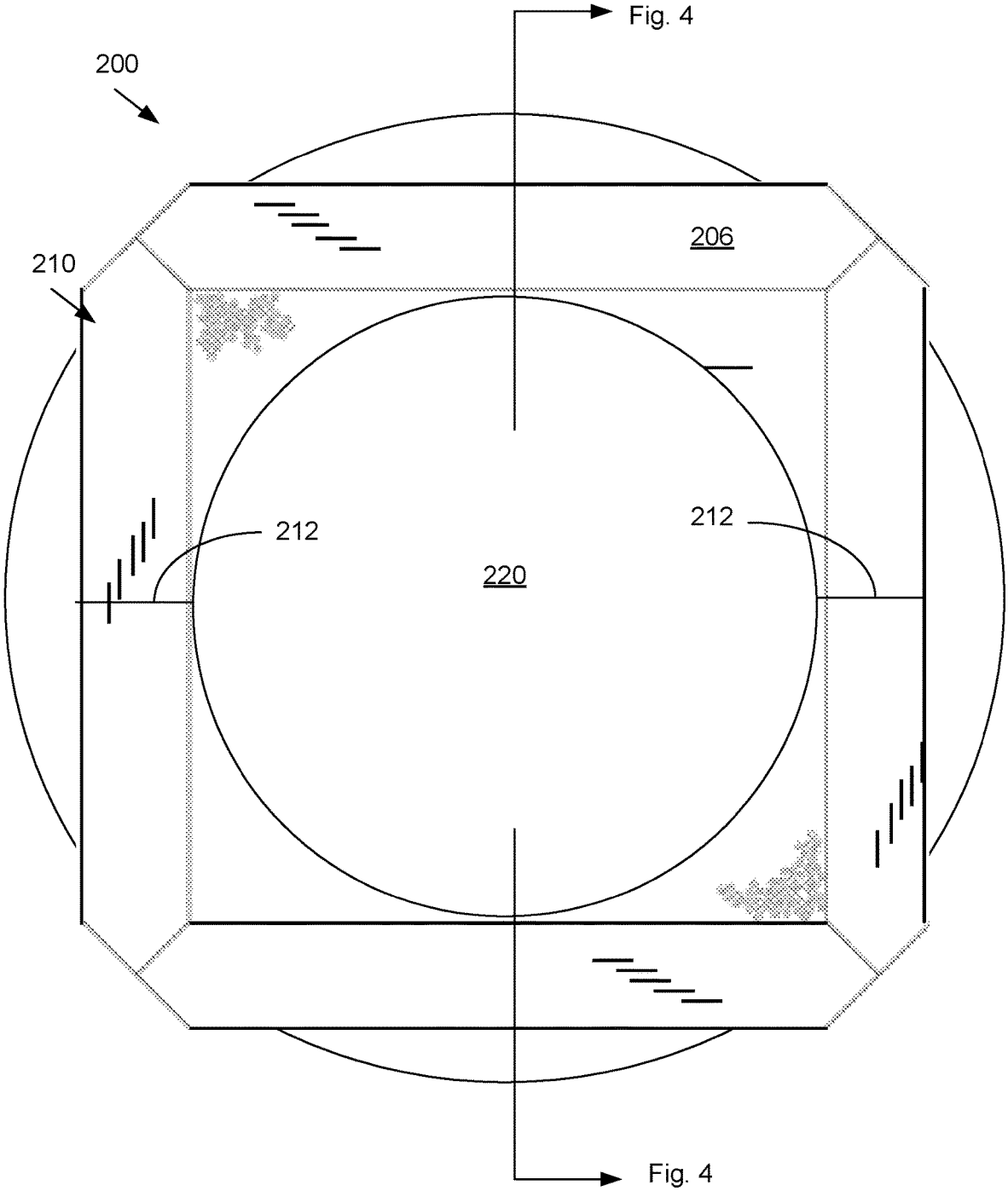
FIG. 3 provides a front perspective view of a second embodiment of the training aid disposed about and upon a basketball in accordance with of the present invention.

FIG. 3 provides a front perspective view of a second embodiment of the training aid 200 disposed about and upon a basketball 220 in accordance with the present invention. In this a second embodiment, the training aid 200 is adapted to be disposed over a portion of the outside surface of a basketball 220 so as to at least partially square off a first perspective of the basketball. The training aid 100 is configured and constructed of material that permits the training aid to become removably affixed to the outer surface of the basketball.

The second embodiment training aid 200 comprises an elastic portion that permits expansion to effectively dispose about the basketball 220 in a secured manner. Optionally, the training aid 200 comprises a two-piece housing 210 and further comprises a fixation mechanism 212 to secure the two-piece housing about the basketball 220 when place on the basketball; comprising a housing adapted to receive through an internal cavity a basketball 220, whereby with the basketball received in the cavity the training aid provides at least one squared off perspective. In this manner, with the basketball 220 disposed within the internal cavity the basketball securely engages an inner surface of the training aid so as to be fixably disposed thereon and to prevent undesired disconnection with the training aid 200. The training aid 200 includes one or more of the following to secure the aid in position about the basketball, a VELCRO hook-and-loop fastener strap, a clip and strap combination, an elastic material adapted to be removably disposed about the basketball. In one manner, where openings are sufficient in combination with the elasticity of the material used, then the training aid may be placed about the basketball based on sufficient deflection and will remain securely in place when the material returns to a less expanded state. The training aid may then be removed by applying sufficient force to overcome the retractive nature of the material.

With the training aid 200 securely disposed on the basketball 220 the aid presents essentially a sphere (basketball 220) protruding from the six faces of a cube defined set of planes. In one configuration the training aid is in the form of an open faced, cube-shaped combination removably attached to the outer surface of the basketball 220. The substantially cube-shaped training aid 200 is approximately the size of a conventional basketball and has at least one side transition 206, whereby when the training aid is launched in the manner of a basketball shot the rotation of the training aid provides visual feedback representative of a nature of the rotation of the device in flight. In at least one manner of using the training aid, with the basketball placed in a user's hand for shooting the user's hand at least partially engages with the training aid.

Figure 4:
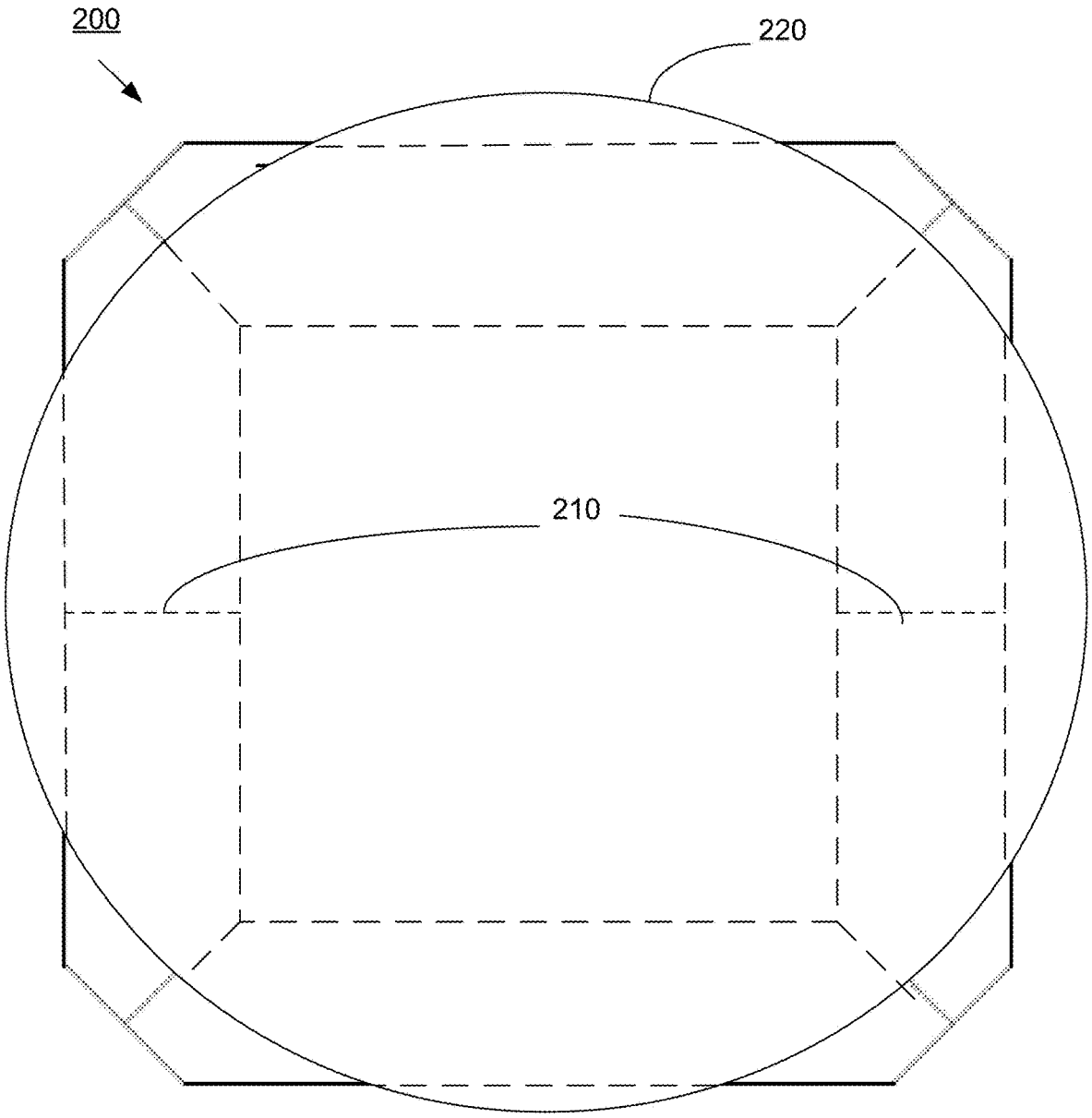
FIG. 4 provides a cross-section view of the exemplary second embodiment of FIG. 3.

FIG. 4 provides a cross-section view of the exemplary second embodiment of FIG. 3 showing basketball 220 with training aid 200 in a cube-like shape at four corners.

Figure 5:
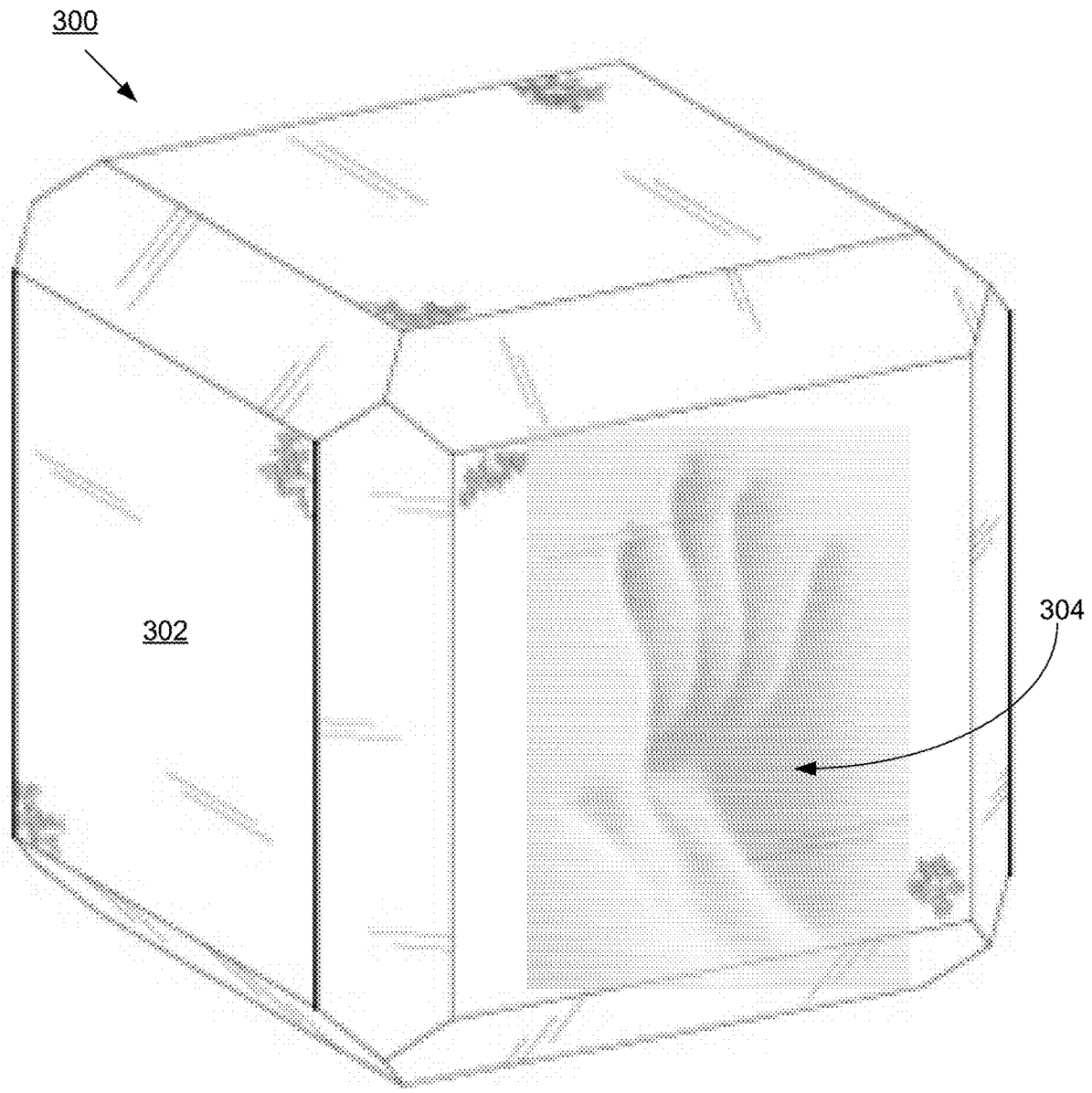
FIG. 5 provides a perspective view of a third embodiment of the training aid in accordance with the present invention having a hand indent to assist in placement of a user's shooting hand.

FIG. 5 provides a perspective view of a third embodiment training aid 300 in accordance with the present invention having a hand indentation 304 formed in at least one face of the cube training aid to assist in placement of a user's shooting hand. In addition to the cube-shaped training aid itself, and as an alternative to having a hand indentation, one version of the Qube may be combined with VELCRO hook-and-loop fastener gloves or some other means of attaching the hands to the Qube.

The Qube (also referred to as cube in this document) can be made of a solid material such as foam, rubber, sponge, leather, composite or synthetic leather as well as any other light weight material that can be molded or cut into a "cube" shape. The Qube may also be inflatable with a bladder inside a composite material i.e. Leather, or other indoor/outdoor material. The Qube comes in several conventional sizes: 9.5 inch cube (the diameter of a high school, college, professional, and international round basketball); 9 inch cube for middle school (both genders) and female high school athletes; 5-inch cube for children ages 4-10 years old.

The Qube may be outfitted with an electronic or manual level to ensure the correct elbow wrist relationship is achieved. Some versions of the Qube will illuminate when the elbow wrist relationship is correct which indicates it is time to shoot. This function is critical in assisting the shooter to learn how to shoot straight. Missing a shot left or right is undesirable. However, if the shot is a little long or short it can still go in. Sizes may range from a 1" Qube to a 30" Qube. The most common sizes for basketball (and all other sports) will be from 5"-30" cubes.

The Qube is preferably made of foam, rubber, Styrofoam, sponge, leather, composite leather and any other lightweight material that can be molded in the form of a cube.

Instructions for using the Qube based on the desired method are as follows as critical aspects to shooting a basketball properly. First and most important—the student have to learn to shoot straight. Most important—the student must learn to shoot straight everything else the student does should be geared toward accomplishing that goal. Missing a shot left or right of the rim must be avoided. Elbow/wrist should be aligned from 0-10 degrees, and palm must be level. Hand placement—the student guide hand is important, learn the proper placement and learn how to keep it from interfering with the student's shot. The student must shoot with proper arc to give the shot the optimal chance of going in—higher the arc, the larger the target becomes. If the student shoots right handed his right foot should be slightly forward, (it helps line up the wrist and elbow if turn toes in about 10 degrees pointing the same direction) and should have a slight bend in your knees during shot.

Critical teaching elements in using the Qube are: Shoot straight; Hand placement; Qube must be level; Elbow-wrist alignment should be 0-5 degrees; Shoot straight up to attain sufficient arc on the ball; Keep forearm perpendicular to the biceps when bringing up the ball, creating a 90-degree angle at the elbow; Left hand guides and balances ball, but never pushes it or exerts force on the ball; Head does not move; Release height of the Qube depends upon the height of the player shooting.

The Qube may be used for purposes of athletic/fitness/exercise training. The Qube training device may be solid or it may be inflated. The most common weight for the basketball training Qube will range from 5 ounces to 32 ounces. The Qube basketball training device is unique in that it features a level device to let the user know when their elbow wrist form is aligned properly and the user is then ready to shoot. The device may illuminate or there will be some sort of visual queue, which alerts the user that their form is correct. The weight range for the fitness cube will range from 1 lb. to 50 lbs. One reason that the fitness cube (Qube) is preferred over the round stability ball is when the round stability ball is left on the floor often times it just rolls away . . . inconveniencing the user. The Qube doesn't roll. Qubes from 8 inches to 15 inches may have a Dual application for sports and fitness and has a variety of uses for many sports . . . soccer, basketball, football, baseball etc.

In training a person how to shoot a basketball, the most important two things about shooting are learning how (and why) to shoot straight and how (and why) to get sufficient arc on the ball when shooting. So often a coach gives a verbal que and then expects the player to do just what was instructed. In the player's mind/eye he/she does just what the coach said. The problem is something gets lost in the translation. With the QUBE's "cubed shape" there is no loss in translation there is only immediate visual feedback to both the coach and to the student/player. There is a direct connection as to where to locate hands and how to properly align the wrist and elbow to promote shooting straight. In one manner the QUBE may actually illuminate when a player's hands are placed properly and wrist and elbow are properly aligned. This creates a muscle memory that is easily transferred to a real basketball.

The science of shooting a basketball tells us the release height of the basketball shot is largely determined by the height of the player shooting. According to Professor John Fontanella, the ideal angles from the free throw line are as follows: 5'4" player should launch the ball at a 52.2-degree angle; 5'8" player should launch the ball at a 51.5-degree angle; 6'0" player should launch the ball at a 50.8-degree angle; 6'4" player should launch the ball at a 50.1-degree angle; 6'8" player should launch the ball at a 49.4-degree angle; 7'0" player should launch the ball at a 48.7-degree angle. These angles produce the slowest moving ball as it approaches the rim, which gives you a shooter's touch. Ideal arc from the free throw line is approximately 50 degrees. Ideal arc height from the 3-point line is approximately 16 feet or 45.55 degrees . . . the higher the arc the more force. The higher trajectory allows the shooter to launch the ball over taller defenders additionally, it creates a larger target. The steeper a shot, the wider the opening into the rim. Dallas Mavericks free-throw coach Gary Boren has a peculiar way of illustrating this fact. He lowers a hoop to the floor and has players climb a ladder. "You can't change the size of the ball," he said, "but you can change the size of the target."

Figure 6:
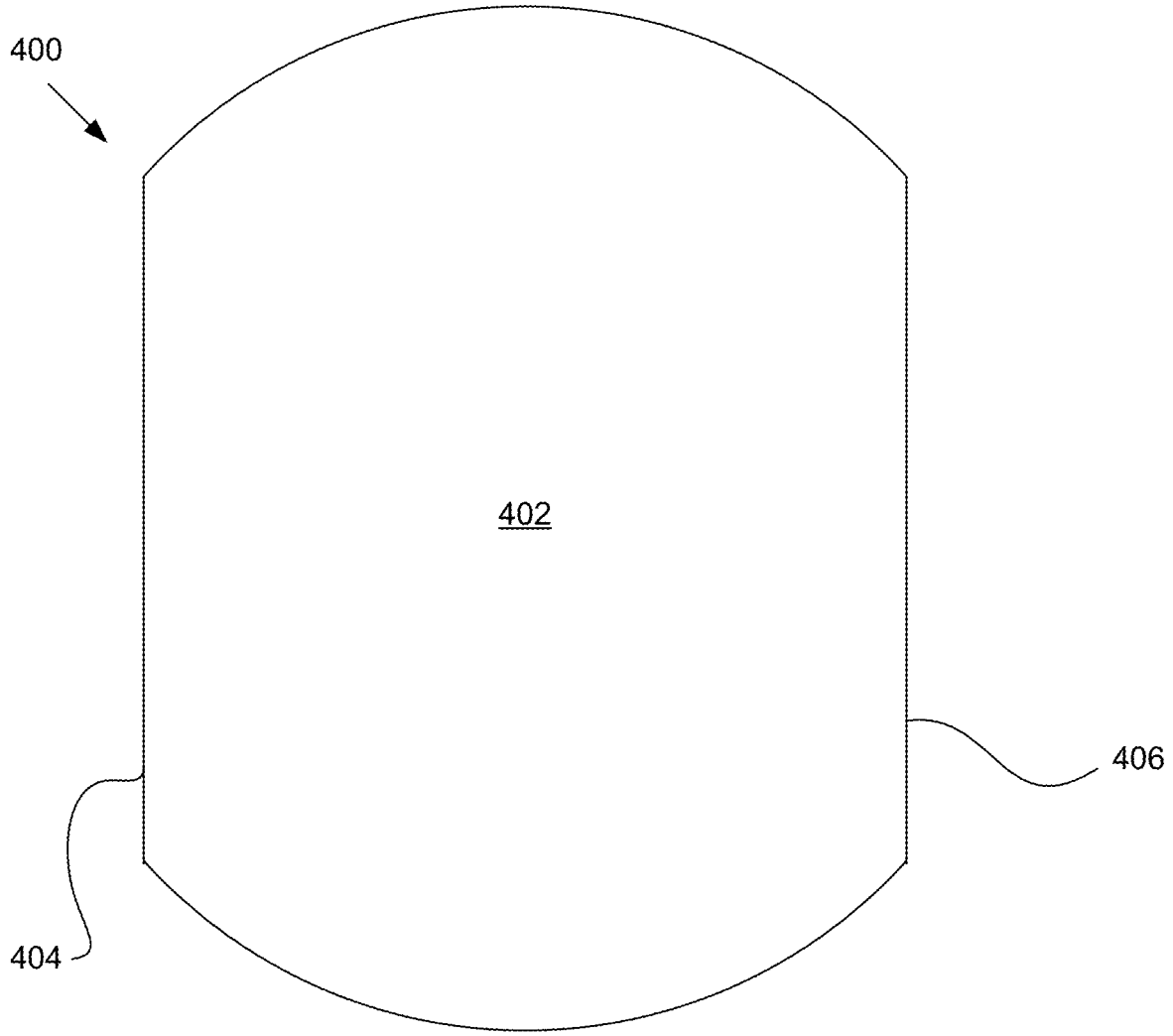
FIG. 6 provides a front view of a fourth embodiment of the training aid in accordance with the present invention being substantially spherical and having one or more flat sides.
Figure 7:
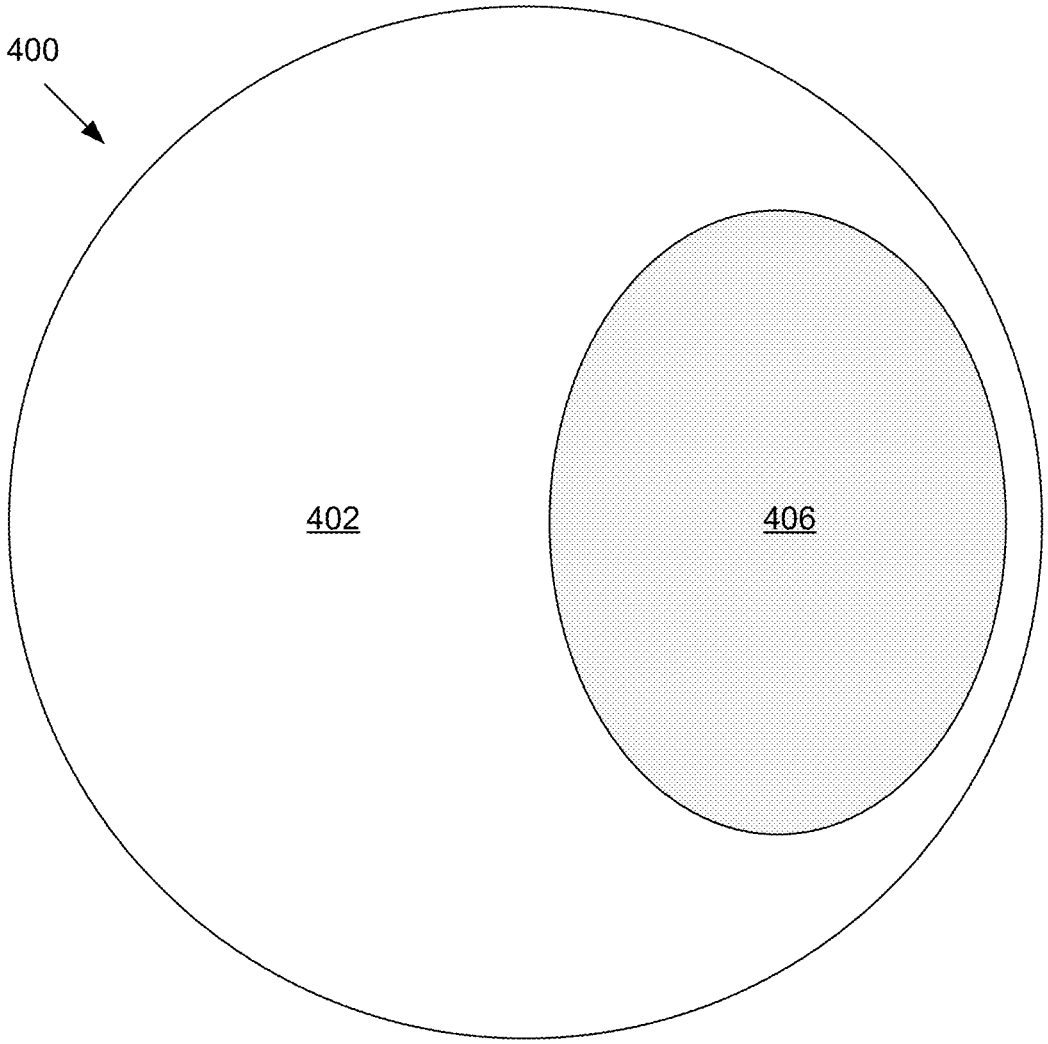
FIG. 7 provides a perspective view of the exemplary fourth embodiment of FIG. 6.

With reference now to FIGS. 6 and 7, a fourth embodiment of a substantially spherical training aid 400 according to the present invention is provided. The training aid 400 may comprise similar features to the training aids 100 and 300, but is substantially spherical in shape. The training aid 400 has a spherical body 402 and one or more flat surfaces 404 and 406 that function similar to the flat sides 102 of training aid 100 in FIG. 1. The training aid 400 may have any number of flat sides 1 . . . n based on the training needs of the user.

While the invention has been described by reference to certain preferred embodiments, it should be understood that numerous changes could be made within the spirit and scope of the inventive concept described. Also, the present invention is not to be limited in scope by the specific embodiments described herein. It is fully contemplated that other various embodiments of and modifications to the present invention, in addition to those described herein, will become apparent to those of ordinary skill in the art from the foregoing description and accompanying drawings. Thus, such other embodiments and modifications are intended to fall within the scope of the following appended claims. Further, although the present invention has been described herein in the context of particular embodiments and implementations and applications and in particular environments, those of ordinary skill in the art will appreciate that its usefulness is not limited thereto and that the present invention can be beneficially applied in any number of ways and environments for any number of purposes. Accordingly, the claims set forth below should be construed in view of the full breadth and spirit of the present invention as disclosed herein.

What is claimed is:

1. A substantially cube-shaped polyhedral training aid being approximately the size and weight of a conventional basketball, and having a set of faces, a set of corners, and a plurality of side transitions, the plurality of side transitions comprising side transitions having flat surfaces providing hexagonal chamfered edges disposed between each face in the set of faces;

wherein three of the plurality of hexagonal side transitions meet at each corner of the set of corners forming corners that end at an end point, each corner defined by two edges of each of the three of the plurality of hexagonal side transitions; and wherein one or more of the set of faces of the training aid comprise a pebbled surface to replicate the leather of a basketball and a surface conducive to gripping;

whereby when the training aid is launched in the manner of a basketball shot the rotation of the training aid provides visual feedback representative of a nature of the rotation of the device in flight, the visual feedback indicated by the plurality of hexagonal side transitions and the pebbled surface of the one or more faces of the set of faces.

2. The training aid of claim 1, further comprising a level indicator device.

3. The training aid of claim 2, further comprising wherein the level indicator device comprises a visual level having a bubble float with translucent body.

4. The training aid of claim 2, wherein the level indicator device is one of a visual level having a bubble float with translucent body, a sound indicator, and a vibration indicator.

5. The training aid of claim 1, further comprising visual outer-markings on one or more external surfaces of the aid to give further visual indication of the nature of the rotation of the device when launched.

6. The training aid of claim 5, wherein the outer-markings comprise one or more of color portions, stripes, arrows, series of stripes or illuminated or reflective indicators.

7. The training aid of claim 1, further comprising at least one surface having a hand-shaped indention intended for the user to place a shooting hand into when practicing with the aid.

8. The training aid of claim 1, wherein the set of faces comprises 6 sides and the plurality of hexagonal side transitions comprises 12 hexagonal side transitions.

* * * * *